US008225974B2

(12) United States Patent
Zheng et al.

(10) Patent No.: US 8,225,974 B2
(45) Date of Patent: Jul. 24, 2012

(54) CARRYING BAG WITH SUPPORT

(75) Inventors: Yu Zheng, Walnut, CA (US); Rachel Lee Zheng, Walnut, CA (US); Alicia Lea Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 721 days.

(21) Appl. No.: 12/317,195

(22) Filed: Dec. 19, 2008

(65) Prior Publication Data

US 2010/0155447 A1 Jun. 24, 2010

(51) Int. Cl.
*A45F 4/02* (2006.01)
*A45C 15/00* (2006.01)

(52) U.S. Cl. ..... 224/628; 224/630

(58) Field of Classification Search ..... 224/576, 224/153, 629, 645, 628, 630
See application file for complete search history.

(56) References Cited

U.S. PATENT DOCUMENTS

| | | | | |
|---|---|---|---|---|
| 4,687,414 | A * | 8/1987 | Wardy | 416/63 |
| 5,911,348 | A * | 6/1999 | Shook | 224/629 |
| 6,179,186 | B1 | 1/2001 | Blanking | |
| 6,325,262 | B1 * | 12/2001 | Thompson | 224/628 |
| 6,607,107 | B2 * | 8/2003 | Dexheimer | 224/604 |
| 6,626,341 | B2 * | 9/2003 | Mitchell | 224/576 |
| 6,892,915 | B2 * | 5/2005 | Mares | 224/630 |
| 7,249,464 | B1 * | 7/2007 | Watson | 62/3.2 |
| 7,300,484 | B2 * | 11/2007 | Scully et al. | 55/385.1 |
| 2002/0060107 | A1 * | 5/2002 | Kamoshita et al. | 181/214 |
| 2006/0191270 | A1 * | 8/2006 | Warren | 62/3.3 |
| 2008/0295215 | A1 * | 12/2008 | Burke et al. | 2/69 |

* cited by examiner

*Primary Examiner* — Nathan J Newhouse
*Assistant Examiner* — Lester L Vanterpool
(74) *Attorney, Agent, or Firm* — Raymond Sun

(57) ABSTRACT

A carrying bag has a casing defining an interior storage space, a back panel, and a support frame secured between the casing and the back panel, with the support frame defining an air channel. A carrying strap can be secured to the back panel, and a lower back strap can be secured to the back panel. The support frame can be replaced by a housing which carries with it a temperature control device and/or a massage device, or water.

6 Claims, 5 Drawing Sheets

Air
Air
10
12
14
16
18
20
22
24
26
28
30
32
34
38
40
42
50
52
54
55
60
62
64

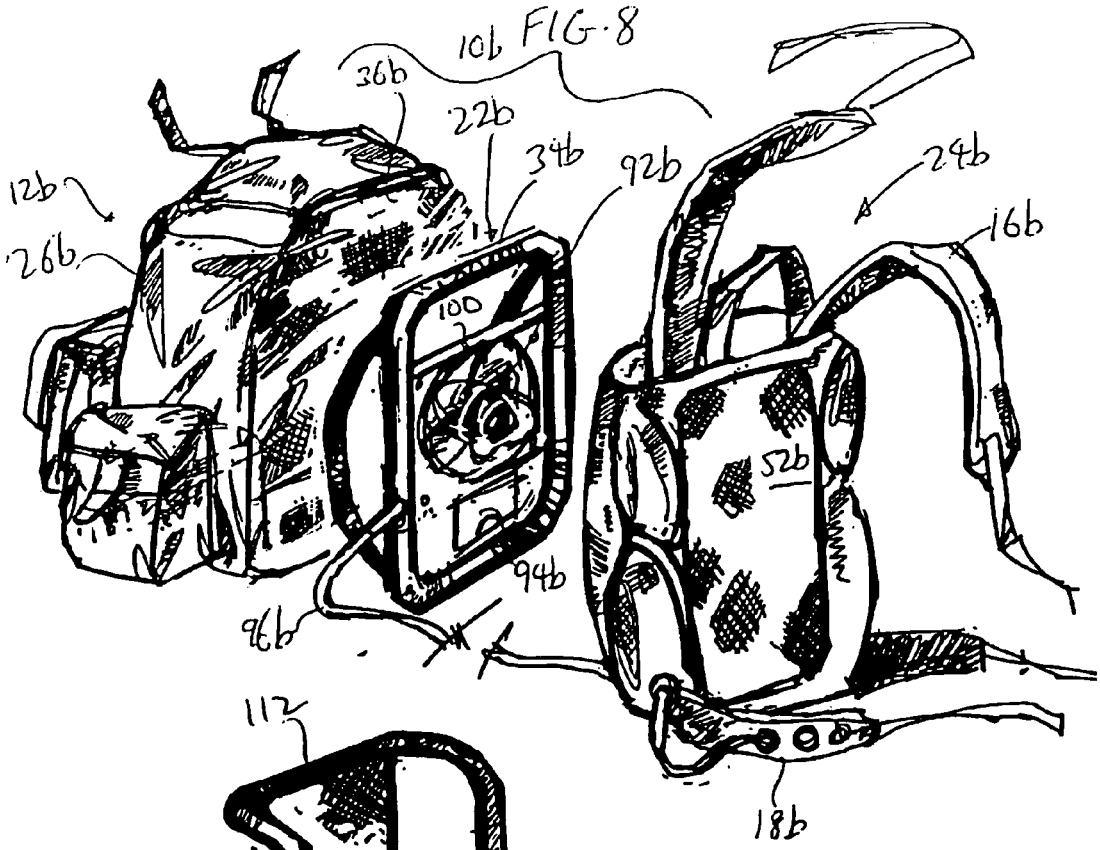
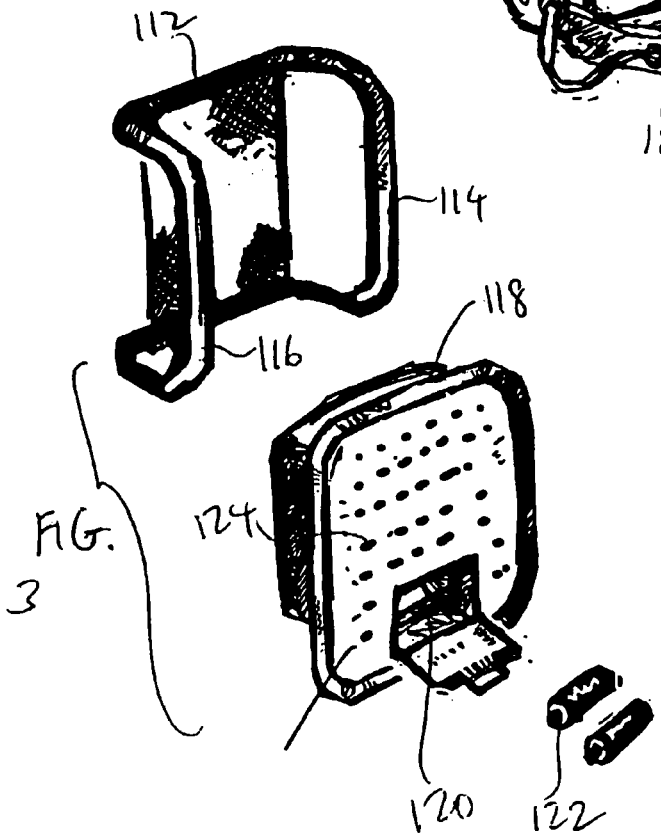
FIG. 3

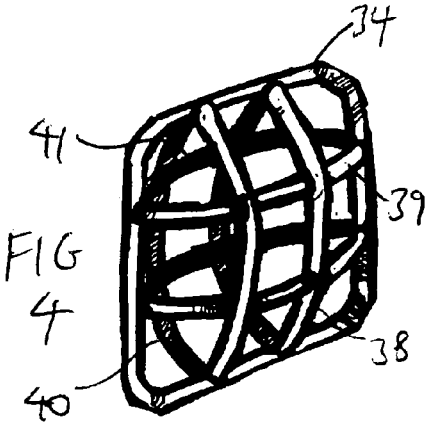
FIG 4
FIG. 5
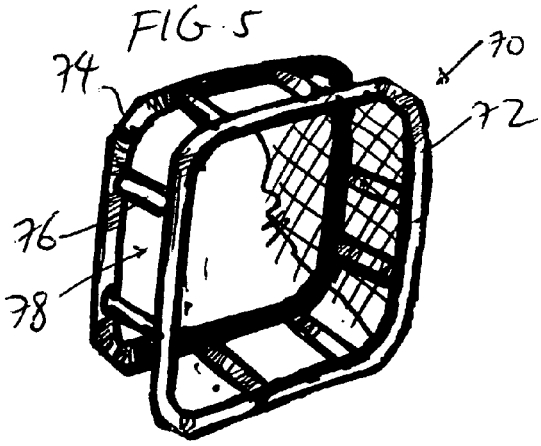
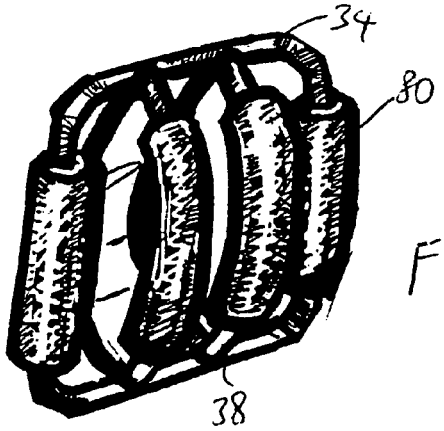
FIG. 6

CARRYING BAG WITH SUPPORT

BACKGROUND OF THE INVENTION

1. Field of the Invention

The present invention relates to backpacks and other carrying bags that are adapted to be carried on a user's back, and in particular, to improvements to a carrying bag.

2. Description of the Prior Art

Backpacks and other carrying bags are commonly used by schoolchildren and adults alike to carry heavy objects like books, travel equipment and the like. Unfortunately, conventional backpacks suffer from several drawbacks.

First, some of these backpacks can often weigh in excess of 20 pounds after they have been packed full. Even backpacks packed with schoolbooks can be quite heavy. Unfortunately, many users, such as young students, often suffer back-related injuries that are attributable to extended use with heavy objects.

Second, some of the items carried in these backpacks often have sharp or blunt ends that may press against the user's back. This can cause discomfort, or even injury, to the user depending the nature of the item.

Third, since a conventional backpack typically presses against a user's back, there is no ventilation of the user's back, thereby causing the user to sweat.

The above-described three drawbacks collectively lead to discomfort, and in extreme cases, possible injury, to the user.

SUMMARY OF THE DISCLOSURE

It is an object of the present invention to provide a backpack or carrying case that addresses the drawbacks set forth above.

In order to accomplish the objects of the present invention, the present invention provides a carrying bag having a casing defining an interior storage space, a back panel, and a support frame secured between the casing and the back panel, with the support frame defining an air channel. A carrying strap is secured to the back panel, and a lower back strap is secured to the back panel. In other embodiments, the support frame can be replaced by a housing which carries with it a temperature control device and/or a massage device, or water.

BRIEF DESCRIPTION OF THE DRAWINGS

FIG. 3 illustrates an embodiment of a heater that can be used with any of carrying bags of the present invention.

FIGS. 4-6 illustrate different embodiments of the support frame.

FIGS. 7-9 are exploded rear perspective views of different embodiments of the carrying bag of the present invention.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figures 1, 2:
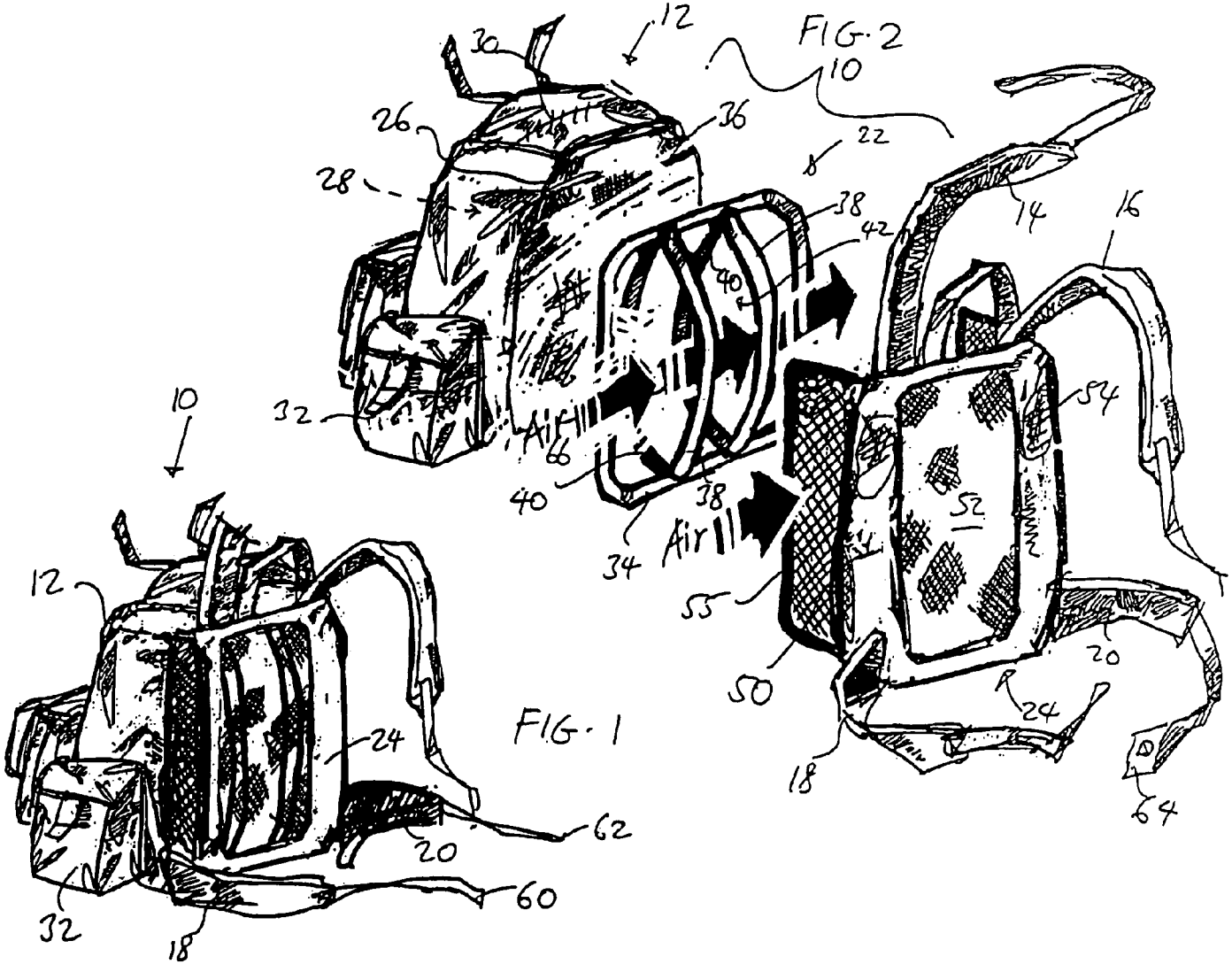
FIG. 1 is a rear perspective view of a carrying bag according to one embodiment of the present invention.
FIG. 2 is an exploded rear perspective view of the bag of FIG. 1.

FIGS. 1-2 illustrate one embodiment of a carrying bag 10. Even though the bag 10 is illustrated in the form of a backpack, the principles of the present invention can be applied to any bag that can be adapted to be carried on the nack of a human being. The bag 10 includes a casing 12, a support frame 22 and a back panel 24, with two carrying straps 14, 16 and two lower back straps 18, 20 connected to the back panel 24. When assembled, the support frame 22 is positioned between the casing 12 and the back panel 24.

The casing 12 has a shell 26 with six sides that together define a storage space 28 inside the shell 26. The shell 26 can be made from any conventional backpack material, such as a tough fabric, canvas or nylon material. The shell 26 can also be made of a rigid material such as wood, metal (e.g., steel), bamboo, or plastic, so that the shell 26 would essentially be a rigid container. As with conventional backpacks, a zipper assembly 30 can be provided along an opening along the shell 26 to allow access into the storage space 28. Additional pockets 32 can optionally be provided anywhere along the shell 26.

The support frame 22 has a peripheral loop member 34 that is adapted to extend along the entire periphery of the rear wall 36 of the casing 12. The loop member 34 defines the shape of the rear wall 36 of the casing 12. A plurality of curved rigid bars 38, 40 extend between two opposite sides of the loop member 34, and are oriented so that each bar 38, 40 curves away from the plane defined by the loop member 34. A first set of rigid bars 38 curves away from the plane defined by the loop member 34, and towards the back panel 24. A second set of rigid bars 40 curves away from the plane defined by the loop member 34, and towards the rear wall 36. With this arrangement, the two sets of bars 38, 40 define an opened and elongated space 42 therebetween. The loop member 34 and the bars 38, 40 can be embodied in the same material, and examples include a steel frame member, and rigid plastic.

The back panel 24 has a body section 50 with a meshed section 52 at about the center thereof. The body section can be made of a relatively flexible yet tough material, such as canvas or nylon. Paddings 54 can be provided along the body section 50 to provide comfort to the user's back. The meshed section 52 is made of a mesh material (e.g., a nylon mesh) that has openings therein so that air from the space 42 can travel freely through the meshed section 52 to provide ventilation to the user's back. Each carrying strap 14, 16 has a top end that is secured to the top edge of the back panel 24, and a bottom end that is secured to the bottom edge of the back panel 24, using conventional techniques. Padding (not shown) can be provided on selected portions of the carrying straps 14, 16 to provide comfort and support for the user's shoulder. Each carrying strap 14, 16 can be made of a fabric or other similar material used by conventional backpacks.

Each lower back strap 18, 20 has one end that is secured to the left or right side edge of the back panel 24 adjacent the bottom thereof, and each lower back strap 18 and 20 also has a free end 60 and 62, respectively, that are adapted to be removably attached to each other. For example, a removable attachment mechanism 64 (e.g., buckles, hooks, ties) can be provided adjacent the free ends 60, 62 to allow the free ends 60, 62 to be removably attached to each other. The lower back straps 18, 20 can be elastic, and be made from a sturdy yet flexible material, such as a leather-type belt, and functions to provide support to the user's lower back. Meshed pieces 55 can be provided along the side edges of the body section 50. The casing 12, the support frame 22 and the back panel 24 can be assembled together as shown in FIG. 1 by stitching one vertical edge of each of the meshed pieces 55 to the corresponding side edges of the rear wall 36 of the casing 12 in a manner where the support frame 22 is secured between the casing 12 and the back panel 24. The support frame 22 can be further secured to the rear wall 36 and the back panel 24 via welding, hooks or other similar attachment mechanisms. When so assembled, the bars 38, 40 separate the casing 12 and the back panel 24 so that an air channel 66 is defined by the space 42 between the two sets of bars 38, 40. This air channel 66 allows external air to enter via the meshed pieces 55 to vent a user's back via the meshed section 52, so as to reduce the propensity for a user to sweat. In addition, the space 42 between the curved bars 38, 40 provides separation between the items inside the casing 12 and the user's back, so that items carried in these backpacks that have sharp or blunt ends will not press against the user's back.

In use, the user pulls the carrying straps 14, 16 over his/her shoulders in the same manner as pulling a conventional backpack over the user's back. Then, the user secures the lower back straps 18, 20 together about the user's lower back area adjacent the waist. The lower back straps 18, 20 function to support the user's lower back area, while the air channel 66 vents the user's back, and the bars 38, 40 provide separation between the items inside the casing 12 and the user's back.

FIGS. 4-6 illustrate different embodiments of the support frame 22. FIG. 4 illustrates a modification to the support frame 22 where two additional sets of transverse bars 39 and 41 extend between the other two opposite sides of the loop member 34, and are oriented so that each bar 39, 41 curves away from the plane defined by the loop member 34. A third set of rigid bars 39 curves away from the plane defined by the loop member 34, perpendicular to the bars 38, and towards the back panel 24. A fourth set of rigid bars 41 curves away from the plane defined by the loop member 34, perpendicular to the bars 40, and towards the rear wall 36.

The support frame 70 in FIG. 5 has two loop members 72, 74 spaced apart by a plurality of spacing bars 76 to define an opened space 78 between the loop members 72, 74. In this embodiment, the loop member 74 can be secured to the rear wall 36 of the casing 12, and the loop member 72 can be secured to the back panel 24, using welding, hooks, or similar attachment mechanisms.

FIG. 6 illustrates a modification to the support frame 22 where a padded material 80 (e.g., foam) can be wrapped around the bars 38 and the vertical sides of the loop member 34 to provide an added cushioning effect for the user.

Figure 7:
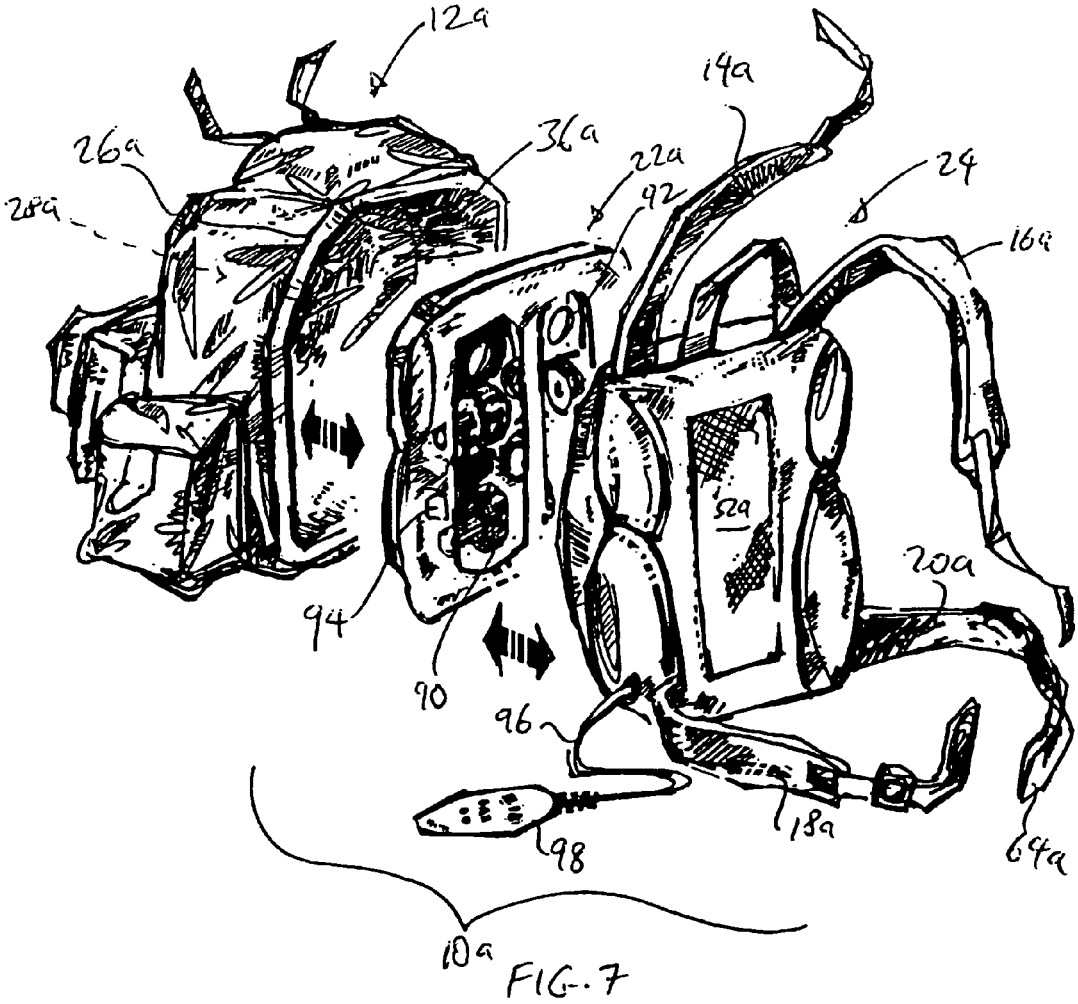

FIG. 7 illustrates another embodiment of a carrying bag 10*a*. The bag 10*a* is very similar to the bag 10 in FIGS. 1-2, so the same numerals are used to designate the same elements found in both FIGS. 1-2 and FIG. 7, except that an "a" has been added to the designations in FIG. 7.

The bag 10*a* differs from the bag 10 in that the support frame 22 of FIGS. 1-2 has been replaced by a housing 22*a*. The housing 22*a* can be used to house a massaging device 90 and a temperature control device 92. For example, massage rollers 90 can be provided in the housing 22*a*, and a cooling or heating element 92 can also be provided in the housing 22*a*. The devices 90, 92 can be electrically connected (via wires (not shown)) to a processor 94 that can be provided in the housing 22*a*. Batteries (not shown) can be provided in the housing 22*a* to power the processor 94 and the devices 90, 92. Additional wiring 96 can be used to connect the processor 94, via the back panel 24 to a control panel 98 that can be used by the user to turn the devices 90, 92 on and off. Thus, the massage device 90 can function to massage the user's back (via the meshed section 52*a*), and the temperature control device 92 can be controlled to cool or warm the user's back. In addition, the housing 22*a* functions to provide separation between the items inside the casing 12*a* and the user's back.

FIG. 8 illustrates modifications that can be made to the bags 10 and 10*a*. The bag 10*b* in FIG. 8 is very similar to the bags 10 and 10*a* in FIGS. 1-2 and 7, so the same numerals are used to designate the same elements found in FIGS. 1-2, 7 and 8, except that a "b" has been added to the designations in FIG. 8.

In FIG. 8, the support frame 22*b* has been modified to incorporate a temperature control device, such as a fan 92*b*, that is mounted to the loop member 34*b* by support bars 100. The curved bars 40*b* can be the same as the curved bars 40 in FIGS. 1-2, and although FIG. 8 does not show any curved bars that correspond to the curved bars 38, such bars can also be provided. The fan 92*b* can be electrically connected to a processor 94*b* that can be provided in the support frame 22*b*. Additional wiring 96*b* can be used to connect the processor 94*b*, via the back panel 24*b* to a control panel (not shown) that can be used by the user to turn the fan 92*b* on and off. The control panel can be provided on the back panel 24*b* itself, or extend separately via a wire as shown in FIG. 7.

Figure 9:
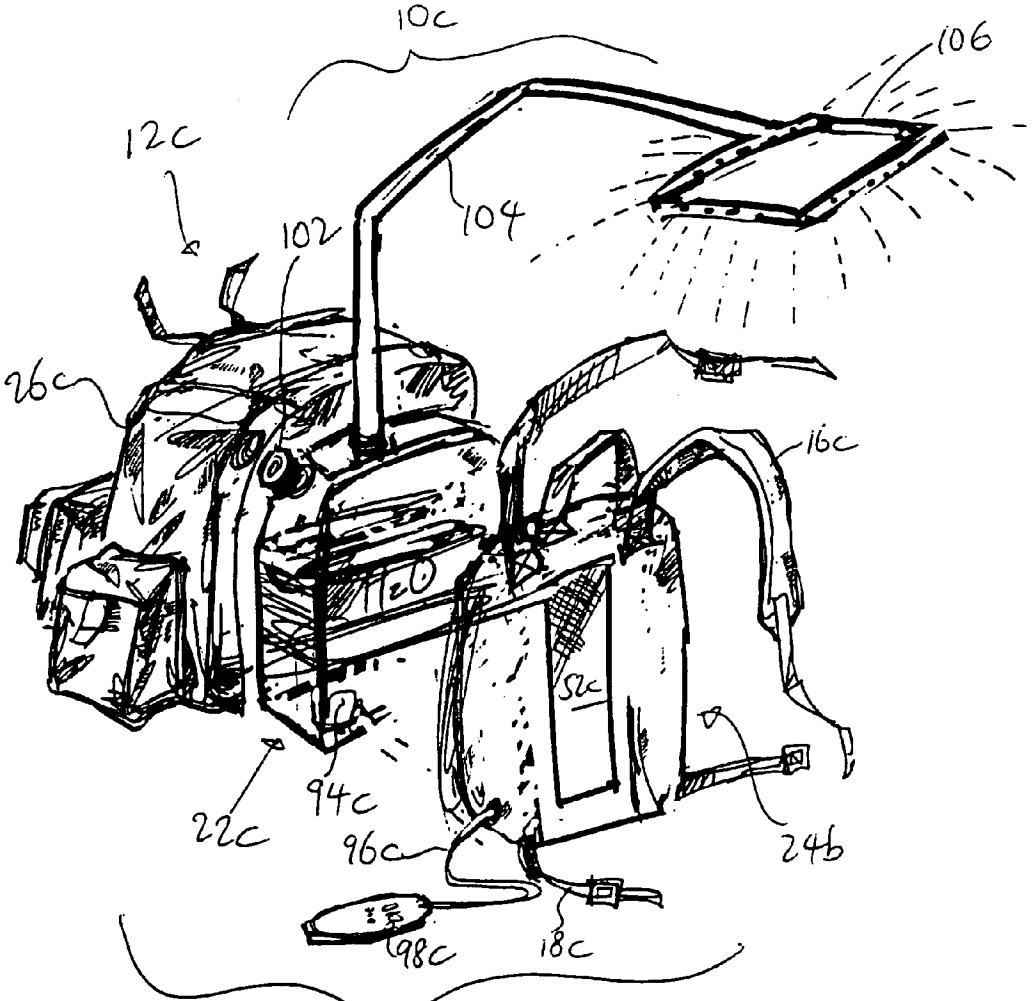

FIG. 9 illustrates modifications that can be made to the bags 10, 10*a* and 10*b*. The bag 10*c* pin FIG. 9 is very similar to the bags 10, 10*b* and 10*c* in FIGS. 1-2 and 7-8, so the same numerals are used to designate the same elements found in FIGS. 1-2 and 7-9, except that a "c" has been added to the designations in FIG. 9.

The bag 10*c* differs from the bag 10 in that the support frame 22 of FIGS. 1-2 has been replaced by a housing 22*c*. The housing 22*c* can be used to house water, and includes an inlet 102 through which water can be added. A pipe or tubing 104 extends upwardly from the housing 22*c* and delivers water to a water outlet 106 where water can be dripped in the form of droplets or mist. A pump (not shown) can be provided with the housing 22*c* to pump water from inside the housing 22*c* through the tubing 104 to the outlet 106. The pump can can be electrically connected (via wires (not shown)) to a processor 94*c* that can be provided in the housing 22*c*. Batteries (not shown) can be provided in the housing 22*a* to power the processor 94*c* and the pump. Additional wiring 96*c* can be used to connect the processor 94*c*, via the back panel 24*c* to a control panel 98*c* that can be used by the user to turn the pump on and off. Thus, the pump can function to spray cooling water on the user's head (via the outlet 106). In addition, the housing 22*c* functions to provide separation between the items inside the casing 12*c* and the user's back.

FIG. 3 illustrates a heater assembly 110 that can be used to replace the housing 22*a* shown in FIG. 7. The heater assembly 110 can include a loop member 112 having elevated U-shaped ends 114, 116 so that the overall configuration of the loop member 112 allows the loop member 112 to cradle or hold a heater housing 118. The heater housing 118 can include a battery compartment 120 for holding batteries 122. Heat vents 124 are adapted to blow heated air towards the user's back.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A carrying bag, comprising:

a casing defining an interior storage space, the casing having rear wall that has a periphery;

a back panel;

a support frame secured between the casing and the back panel to space the back panel from the casing, the support frame having a peripheral loop member that extends along the entire periphery of the rear wall of the casing in a plane, a plurality of curved rigid bars extending between two opposite sides of the loop member, and oriented so that each bar curves away from the plane defined by the loop member to define an air channel;

a carrying strap secured to the back panel; and a lower back strap secured to the back panel.

2. The bag of claim 1, wherein some of the curved bars are padded.

3. The bag of claim 1, further including a temperature control device mounted in the support frame and directing air towards the back panel.

4. The bag of claim 3, wherein the temperature control device is a fan.

5. The bag of claim 3, wherein the temperature control device is a heater.

6. The bag of claim 1, wherein the back panel includes a meshed section communicating with the air channel.

* * * * *